US009743812B2

(12) United States Patent
Courtney

(10) Patent No.: US 9,743,812 B2
(45) Date of Patent: Aug. 29, 2017

(54) DEVELOPMENTS IN OR RELATING TO HAND DRYING

(75) Inventor: Stephen Benjamin Courtney, Bath (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 66 days.

(21) Appl. No.: 14/407,930

(22) PCT Filed: Jun. 14, 2012

(86) PCT No.: PCT/GB2012/051373

§ 371 (c)(1),
(2), (4) Date: Feb. 6, 2015

(87) PCT Pub. No.: WO2013/186510

PCT Pub. Date: Dec. 19, 2013

(65) Prior Publication Data

US 2015/0164289 A1 Jun. 18, 2015

(51) Int. Cl.

| | |
|---|---|
| ***F26B 21/00*** | (2006.01) |
| ***A47K 10/00*** | (2006.01) |
| ***A47K 10/48*** | (2006.01) |

(52) U.S. Cl.

CPC ..... *A47K 10/00* (2013.01); *A47K 10/48* (2013.01); *F26B 21/004* (2013.01); *A47K 2210/00* (2013.01)

(58) Field of Classification Search

CPC ..... F26B 19/00; F26B 21/00; F26B 21/004; E03C 1/00; E03C 1/01; A45D 20/00; A47K 10/00; A47K 10/48

USPC ..... 34/90, 100, 201; 4/619, 623; 392/380, 392/384, 385; 8/149, 159; 134/56 R, 134/102.3

See application file for complete search history.

(56) References Cited

U.S. PATENT DOCUMENTS

| | | | | |
|---|---|---|---|---|
| 4,144,596 | A | 3/1979 | MacFarlane et al. | |
| 4,295,233 | A | 10/1981 | Hinkel et al. | |
| 4,398,310 | A * | 8/1983 | Lienhard | A47K 10/48 4/623 |
| 5,074,322 | A | 12/1991 | Jaw | |

(Continued)

FOREIGN PATENT DOCUMENTS

| | | |
|---|---|---|
| EP | 2 177 142 | 4/2010 |
| EP | 2 399 497 | 12/2011 |

(Continued)

OTHER PUBLICATIONS

International Search Report and Written Opinion mailed Mar. 26, 2013, directed to International Application No. PCT/GB2012/051373; 9 pages.

(Continued)

*Primary Examiner* — Stephen M Gravini
(74) *Attorney, Agent, or Firm* — Morrison & Foerster LLP

(57) ABSTRACT

An arrangement comprises a sink and a sink fixture. The fixture has a water spout arranged to project over the basin of the sink, the water spout having a water nozzle arranged for connection through the spout to a water supply. The fixture also incorporates an elongate air-knife discharge outlet connected to an air supply for discharging an air-knife onto a user's hand. The air-knife discharge outlet is angled downwards so that the air-knife is directed down into the basin of the sink.

11 Claims, 8 Drawing Sheets

(56) References Cited

U.S. PATENT DOCUMENTS

| | | | | |
|---|---|---|---|---|
| 5,522,411 | A | 6/1996 | Johnson | |
| 5,727,579 | A * | 3/1998 | Chardack | A47K 10/48 134/102.3 |
| 7,614,160 | B2 | 11/2009 | Kameishi et al. | |
| 7,971,368 | B2 | 7/2011 | Fukaya et al. | |
| 8,155,508 | B2 | 4/2012 | Caine et al. | |
| 8,296,875 | B2 | 10/2012 | Loberger | |
| 8,381,329 | B2 | 2/2013 | Bayley et al. | |
| 8,572,772 | B2 | 11/2013 | Wolf et al. | |
| 8,950,019 | B2 | 2/2015 | Loberger et al. | |
| 8,997,271 | B2 | 4/2015 | Bayley et al. | |
| 2004/0128755 | A1 | 7/2004 | Loberger | |
| 2009/0000142 | A1 | 1/2009 | Churchill et al. | |
| 2009/0293192 | A1 | 12/2009 | Pons | |
| 2012/0017459 | A1 | 1/2012 | Kikuchi et al. | |
| 2012/0291195 | A1* | 11/2012 | Courtney | A47K 10/48 4/638 |
| 2013/0340272 | A1* | 12/2013 | Courtney | A47K 10/48 34/90 |
| 2015/0135429 | A1* | 5/2015 | Dyson | A47K 10/48 4/678 |
| 2015/0164287 | A1* | 6/2015 | Maclaine | A47K 10/48 34/90 |
| 2015/0164288 | A1* | 6/2015 | Courtney | A47K 10/48 34/90 |
| 2015/0164289 | A1* | 6/2015 | Courtney | A47K 10/48 34/90 |

FOREIGN PATENT DOCUMENTS

| | | | | |
|---|---|---|---|---|
| EP | 2 842 870 | | 3/2015 | |
| EP | 2 861 115 | | 4/2015 | |
| GB | 2 456 937 | | 8/2009 | |
| GB | WO 2012156737 | A1 * | 11/2012 | A47K 10/48 |
| GB | WO 2013186510 | A1 * | 12/2013 | A47K 10/48 |
| GB | KR 20140014271 | A * | 2/2014 | A47K 10/48 |
| GB | 2500606 | B * | 11/2014 | F26B 21/004 |
| JP | 2002-136448 | | 5/2002 | |
| JP | 2004-261510 | | 9/2004 | |
| JP | 2006-304926 | | 11/2006 | |
| JP | 2008-5883 | | 1/2008 | |
| JP | 2009-523047 | | 6/2009 | |
| KR | 10-0909730 | | 7/2009 | |
| WO | WO-2009/039290 | | 3/2009 | |
| WO | WO-2010/088975 | | 8/2010 | |
| WO | WO-2010/095251 | | 8/2010 | |
| WO | WO-2011/074018 | | 6/2011 | |
| WO | WO-2012/076521 | | 6/2012 | |
| WO | WO-2013/186507 | | 12/2013 | |
| WO | WO-2013/186508 | | 12/2013 | |

OTHER PUBLICATIONS

Mitsubishi Electric Corporation. (Aug. 2009). *Jet Towel: Hand-drying for the 21st century*, Gifu, Japan; 8 pages.

Maclaine et al., U.S. Office Action mailed Jun. 24, 2016, directed to U.S. Appl. No. 14/407,924; 9 pages.

* cited by examiner

DEVELOPMENTS IN OR RELATING TO HAND DRYING

REFERENCE TO RELATED APPLICATIONS

This application is a national stage application under 35 USC 371 of International Application No. PCT/GB2012/051373, filed Jun. 14, 2012, the entire contents of which are incorporated herein by reference.

FIELD OF THE INVENTION

The present invention relates generally to the field of hand drying, and in particular to arrangements which use an air-knife to dry the hands.

BACKGROUND OF THE INVENTION

In commercial washrooms, it is common to provide one or more sinks or water basins for washing, and one or more separate, wall-mounted hand-dryers which users can then use to dry their hands.

There are three distinct types of hand dryer on the market: "warm-air" hand dryers, "high speed" hand dryers and "air-knife" hand dryers.

Warm air hand dryers are very well known. They are invariably low flow, low speed machines which rely on heating the air to promote an evaporative drying effect at the surface of the hand. Examples include the Model A Series of hand dryers manufactured and marketed by World Dryer Corporation. The heated airflow is typically discharged through a single nozzle and the drying action is a "hand-over-hand" action, requiring the user to rub the hands together under the nozzle with the aim of encouraging the evaporative drying effect.

High speed hand dryers, as the name suggests, use high speed airflow (>80 m/s) to provide a momentum-drying effect at the surface of the hands. Examples include the Xlerator® hand dryer manufactured and marketed by Excel Dryer Inc. Again the airflow is typically discharged through a single relatively large nozzle and the mode of use is somewhat similar to the "hand-over-hand" action of the warm air dryer, with the hands being held or cupped together underneath the nozzle to dry them. However, instead of being evaporated, the vast majority of the water on the surface of the hands is instead driven or blasted from the hands by the high-momentum airflow, with evaporation accounting for only a small proportion of water removal. The airflow tends not to be heated, though waste heat from the motor may in some cases be used to heat the airflow to a degree.

The third general type of hand dryer is the air-knife hand dryer, examples of which include the Dyson Airblade range of Hand Dryers manufactured by Dyson (UK) Limited and the Jet Towel hand dryer manufactured by Mitsubishi Electric Corporation These hand dryers use an air-knife—a sheet or curtain of moving air—to remove the water from the user's hands. The mode of operation is analogous to the established use of air knives in industry to remove debris or liquid from the surface of a product (see e.g. EP2394123A1, which describes removal of debris from a glass sheet using air knives): the air-knife moves across the surface of the hand and, as it does so, wipes or scrapes the water from the surface of the hand.

In both the Dyson Airblade and the Mitsubishi Jet Towel, two opposing, stationary air-knives are used, one for each side of the user's hand. The hands are inserted between the air-knives and then withdrawn slowly to effect the required relative movement between the hands and the air knives.

In the Dyson arrangement—shown in FIG. 1—the air knives are discharged through narrow, continuous slots (only the rear slot a is visible in FIG. 1), each less than 1 mm wide. In the Mitsubishi arrangement—shown in FIG. 2—the air-knife is instead discharged through opposing rows of individual discharge apertures (only the rear row b is visible in FIG. 2): here, the individual jets combine to produce the air knife downstream of the discharge apertures. In each case, the air knife is discharged at high speed (>80 m/s) to provide for an efficient wiping action across the surface of the hand.

SUMMARY OF THE INVENTION

The present invention concerns an arrangement which uses an air-knife to dry a user's hand.

According to the present invention, there is provided an arrangement comprising a sink and a sink fixture, the fixture comprising a water spout arranged to project over the basin of the sink, the water spout having a water nozzle arranged for connection through the spout to a water supply, the fixture further comprising an air-knife discharge outlet for discharging an air-knife onto a user's hand to dry it, the air-knife discharge outlet being angled downwards so that the air-knife is directed down into the basin of the sink.

One of the problems identified with air-knife dryers is that of managing the disposal of waste water. This is a particular problem for air-knife dryers because the nature of the air-knife drying mechanism means that the water removal is non-evaporative: instead, the water is driven from the hands by the relatively high momentum of the airflow. In the conventional air-knife dryer arrangements described above, the waste water removed from the hands may be collected in a drip tray—which must periodically be emptied—or else is not collected at all and instead simply allowed to evaporate from surfaces on and around the dryer. Neither scheme is particularly hygienic.

The invention advantageously makes use of the existing mains drainage system to manage the waste water more effectively: by incorporating the air-knife dryer on a fixture for a sink so that water driven from the hands can simply drain to mains through the standard drain-hole in the basin of the sink.

The air-knife discharge outlet is angled downwards so that it faces the basin of the sink. This advantageously helps to direct the water droplets down into basin of the sink.

Each air-knife outlet may comprise an elongate discharge aperture or elongate line of discharge apertures. For example, each air-knife outlet may be in the form of an elongate air slot or plurality of elongate air slots. Alternatively, an elongate line of round air holes may be used. The slot, or air holes, may be less than 2 mm wide, intended to provide a laminar, well-defined air knife with minimal wind shear.

The length of each elongate air-knife outlet is preferably greater than 80 mm. This provides a good operational span across the width of a typical user's hand. The preferred length may vary—for example by country.

A single air-knife outlet may be provided, either with the intention of drying the hands one at a time or with the intention of drying both hands simultaneously. In the latter case the length of the outlet is preferably greater than 150 mm—intended to provide a good operational span across both of the user's hands held palm-open in front of the slot.

The air-knife outlet(s) may be provided on an underside of the fixture, though this is not essential. For example, the air-knife outlet(s) may be provided on the underside of the spout, or some other projecting part of the fixture. This is a particularly compact configuration.

Two air-knife discharge outlets may be provided on the underside of the fixture. These outlets may be spaced apart along the length of the spout, for example, with one outlet being provided for each hand. The water nozzle may be provided in-between the two spaced-apart air outlets. This sort of fixture can be mounted to the side of the sink with the spout extending over the basin of the sink: the water nozzle is then disposed centrally between the two air-knife outlets and the user can conveniently place his hands underneath the respective air-knife outlets either side of the water nozzle. Each air-knife outlet may be at least 80 mm across, measured along the length of the spout, to provide for effective drying across the full width of the user's hand. A user can thus pass his hands back and forth—with flat palms—underneath the air nozzles, repeating this action for the reverse side of the hands.

The air-knife discharge outlets may instead be arranged so that they extend laterally from the spout or some other projecting part of the fixture.

The air-knife discharge outlets may be arranged for connection to an air supply via an air duct having a side wall which forms an external part of the fixture. The external part of the fixture may be part of the spout, or may be a part of the fixture—for example a branch duct—extending laterally from the water spout. The air duct may be cylindrical, though again this is not essential.

The air knife outlets are preferably arranged in fixed positions on the fixture. This helps ensure consistent drying performance.

BRIEF DESCRIPTION OF THE DRAWINGS

Embodiments of the invention will now be described with reference to the accompanying drawings, in which.

DETAILED DESCRIPTION OF THE INVENTION

Figure 3:
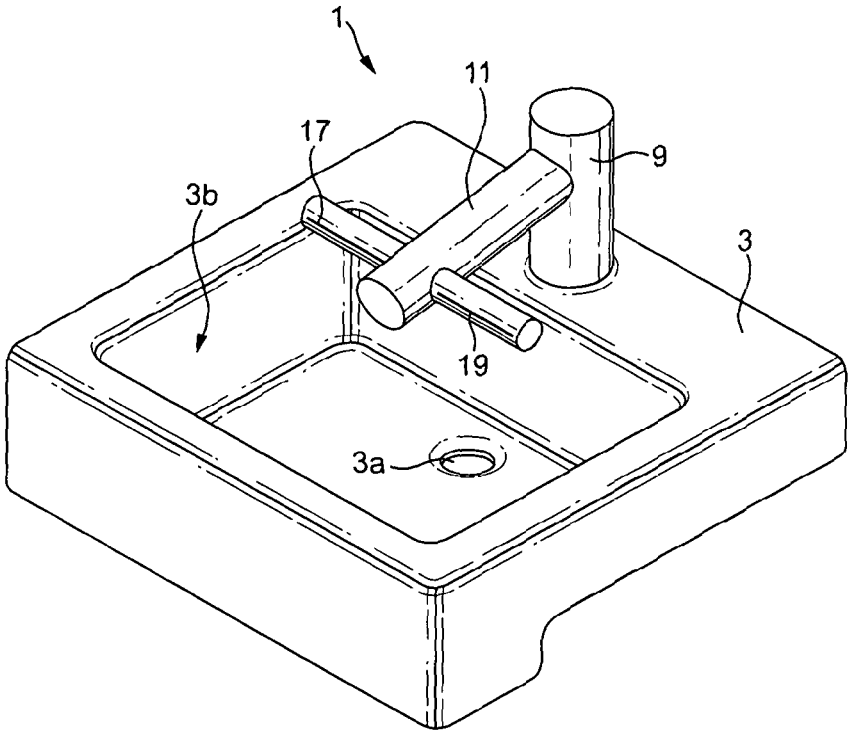
FIG. 3 is a perspective view of an arrangement in accordance with the present invention.
Figure 4:
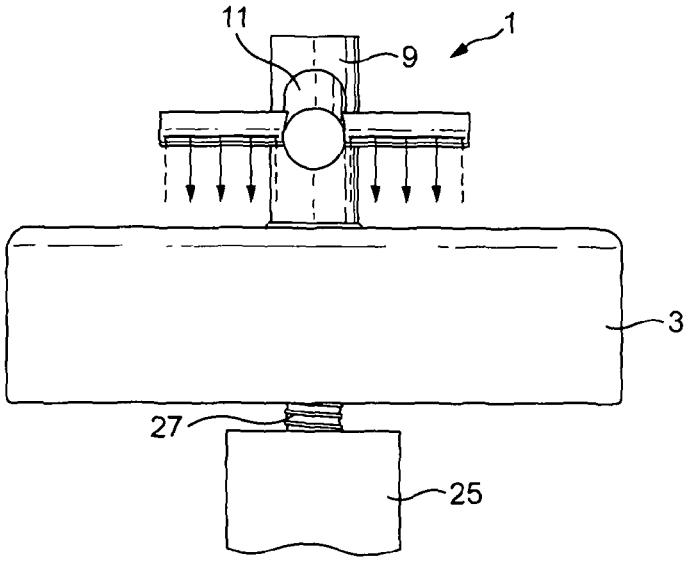
FIG. 4 is a front view of the arrangement shown in FIG. 3.
Figure 5:
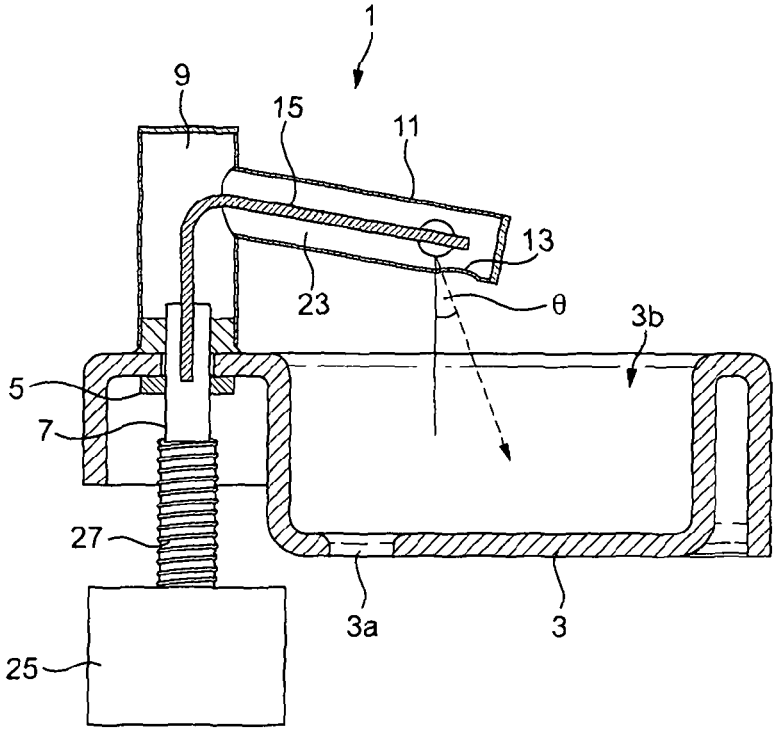
FIG. 5 is a side sectional view of the arrangement shown in FIG. 3.

FIGS. 3-5 show an arrangement comprising a fixture 1 in combination with a sink 3.

The sink 3 is itself conventional. A "Belfast-type" sink is shown, though other types of sink may alternatively be used. The sink 3 has a standard drain-hole 3*a*, in this case positioned towards the rear wall of the basin 3*b* of the sink 3.

The fixture 1 is fitted next to the basin 3*b* of the sink 3 using a locknut 5 underneath the sink 3 which engages with an externally threaded, hollow fixing stud 7 to clamp the fixture 1 in place (the fixture 1 may alternatively be fitted adjacent the sink rather than to the sink itself, according to the style of sink).

The fixture 1 has a tubular construction comprising a vertical, tubular trunk 9 which sits next to the basin 3*b* of the sink 3 and a projecting part, in the form of a spout 11, which projects horizontally from the trunk 9, out over the basin 3*b* of the sink 3. The fixture 1 is formed from metal: for example from conventional rolled steel tubing sections which are then welded together.

A downward facing water nozzle 13 is provided at the end of the spout 11. On demand, water for washing is supplied through the water nozzle 13 from a main supply line (not shown), via a water supply pipe 15 which runs through the trunk 9 and the spout 11.

The fixture 1 is configured for "hands-free" operation to supply water, using a conventional sensor and control loop which automatically opens a stop valve in the supply line, in response to detection of a user's hands in a washing position. Alternatively, the fixture may be configured for manual operation to supply water.

The fixture 1 incorporates a hand dryer of the type which uses an air-knife mechanically to wipe the water from a user's hand. Two air-knives are discharged in use: a first air-knife, which is discharged through an air-knife outlet 17 on the left hand side of the spout and a second air-knife, which is discharged through an air-knife outlet 19 on the right hand side of the spout. Each air-knife outlet 17, 19 takes the form of a narrow elongate slot—less than 2 mm wide.

The branch ducts 21 branch off from a main air duct 23 which runs through the spout 11 and the trunk 9. This air duct 23 is connected to the positive pressure (output) side of a motor-driven fan 25 via a flexible hose 27 which fluidly connects to the inside of the trunk 9 via the hollow fixing stud 7 (if the water supply pipe 15 runs through the fixing stud 7—effectively within the air supply line—then adequate provision will need to be made to route the pipe 15 to the exterior of the air supply line, for connection to the water supply line).

On demand, the fan 25 drives airflow through the air-knife outlets 17, 19 to generate the respective air-knives. The exit airspeed at the air-knife outlets 17, 19 exceeds 80 m/s, and is preferably above 150 m/s. This provides in each case a well-defined air-knife for effective drying of the hands.

The hand dryer is configured for "hands-free" operation using a conventional sensor and control loop, which automatically switches on the fan 25 in response to detection of a user's hands in a drying position (which should be distinguishable from the aforementioned washing position—which automatically activates the water supply). Alternatively, the hand dryer may be configured for manual operation.

Figure 6:
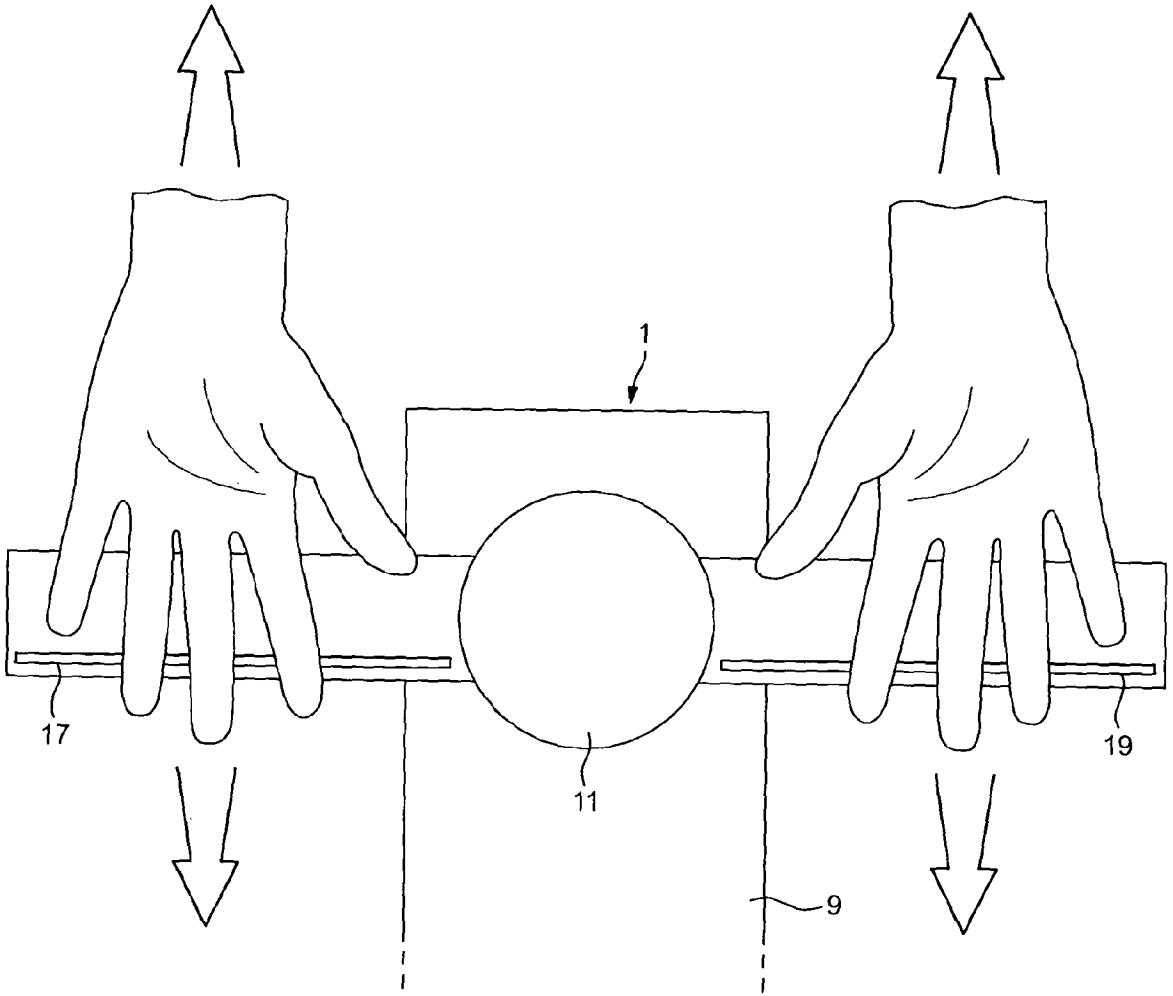
FIG. 6 is a schematic front view of the arrangement in FIG. 3, illustrating use of the fixture to dry the hands.

To commence the hand-drying operation, a user presents his (or her) wet left-hand—palm open—in front of the air-knife outlet 17 on the left hand side of the spout and similarly presents his wet right hand—palm open—in front of the air-knife outlet 19 on the right hand of the spout 11. The sensor and control loop then operates to activate the fan 25, which forces air under high pressure through the discharge apertures 17, 19: directing high-momentum airflow forwards onto the user's hands. The hands are dried one side at a time: first, the user passes his hands up and down in front of the air-knife outlets with the back of the hand facing the air-knife outlets (referred to below as the "standard pass"). This is illustrated in FIG. 6. Then—after turning over the hands—the user passes his (or her) hands up and down in front of the air-knife outlets with the palms facing the air-knife outlets (referred to below as the "reverse pass"). The "standard pass" and "reverse pass" may each be repeated, as required, and carried out in any order.

In accordance with the invention, the air-knife discharge outlets are angled downwards so that, in use, the air-knives are directed down into the basin of the sink.

The downward direction of the air-knives is illustrated by the dashed arrow in FIG. 5. The angle of declination, θ, is 35 degrees. A preferred range is 25 degrees to 45 degrees, ensuring that the air-knives are directed down into the basin of the sink.

Figure 7:
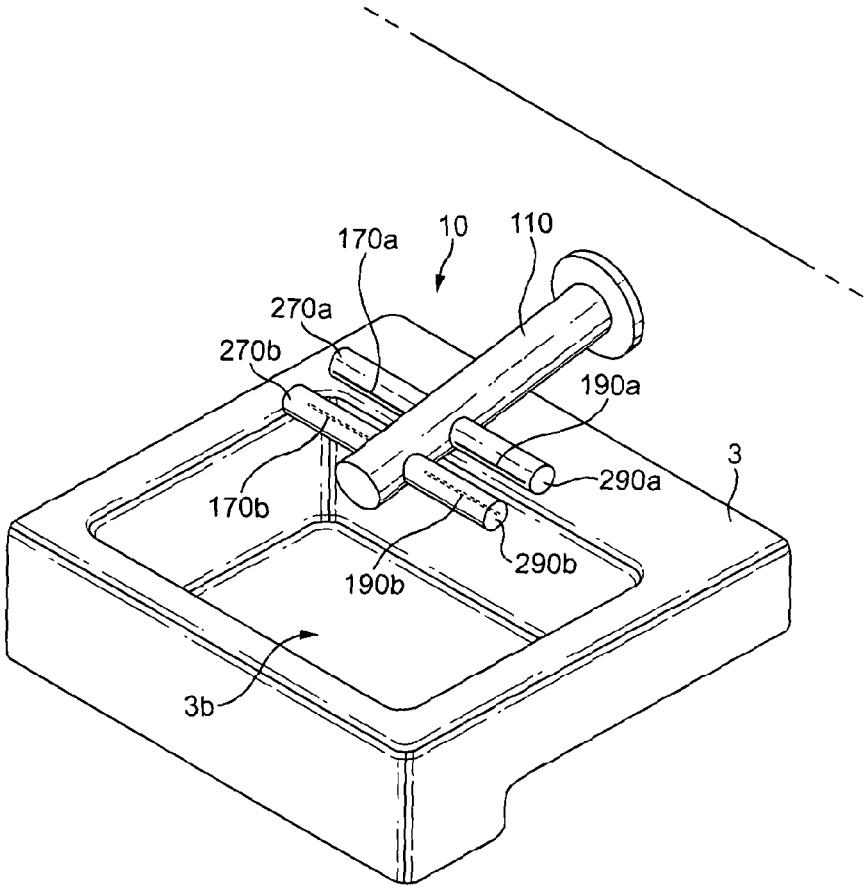
FIG. 7 is a perspective view of an alternative arrangement in accordance with the present invention.
Figure 8:
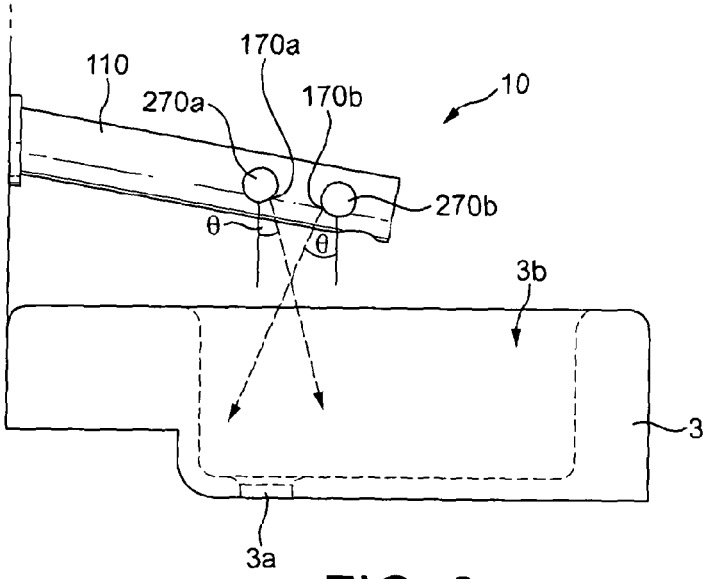
FIG. 8 is a side view corresponding to FIG. 6.

FIGS. 7 and 8 show an alternative arrangement. This differs from the arrangement in FIGS. 3 to 5 in that it is a "double-sided" arrangement: two pairs of opposing air-knife discharge outlets (four outlets in total: 170*a*, 170*b*, 190*a*, 190*b*) are provided on the fixture 10 to dry both sides of the user's hands at the same time during the standard pass. No reverse pass is required.

Each pair of discharge outlets is provided on a respective pair of branch ducts extending laterally from the spout 110 (four branch ducts in total: 270*a*, 270*b*, 290*a*, 290*b*).

The fixture 10 is wall-mounted above the basin 3*b* of the sink 3. Conventional wall fixings may be used for to fit the fixture 10.

The air-knife outlets 170*a*, 170*b*, 190*a*, 190*b* are each angled so that the four air-knives are directed down into the basin of the sink (see FIG. 8). The angle of declination, θ, is 25 degrees in this case.

Figure 9:
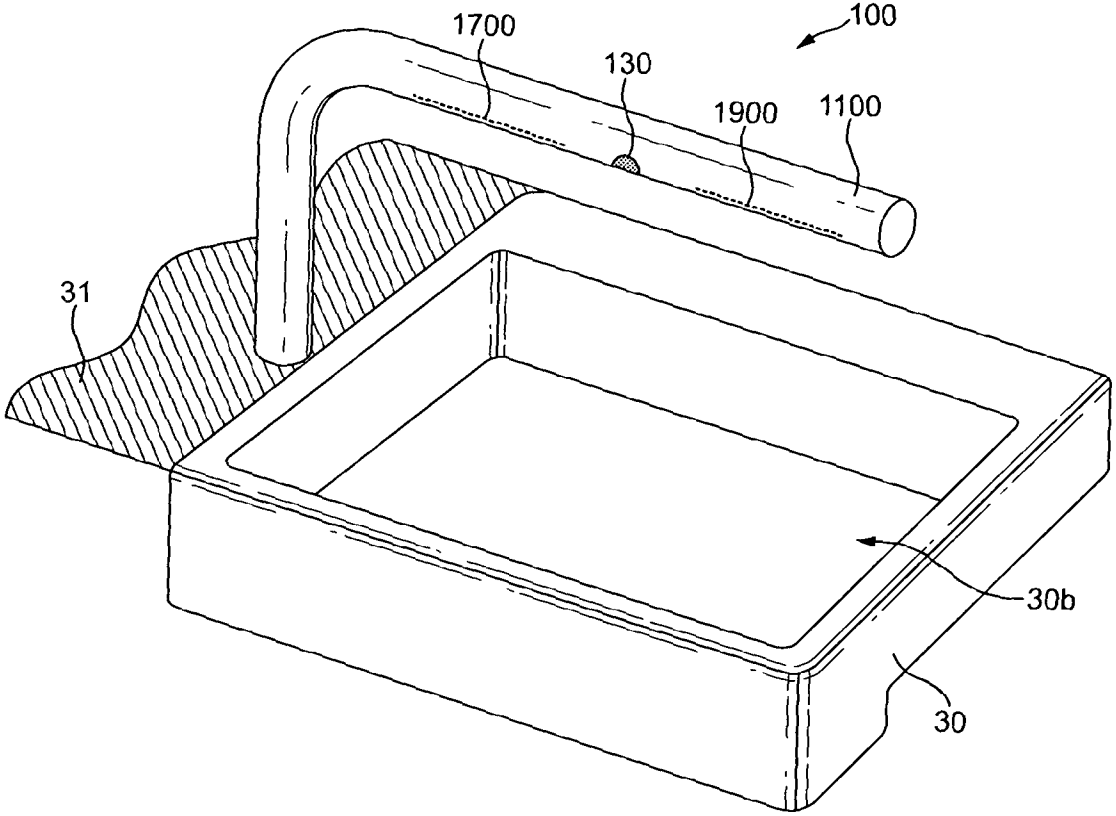
FIG. 9 is a perspective view of a further alternative arrangement in accordance with the invention, in which the fixture is fitted to the side of the sink basin.

FIG. 9 shows a different arrangement, in which the fixture 100 is mounted at the side of the sink 30, rather than at the back of the sink 30 (cf. the previously described arrangements, in which the fixture 1, 10 is mounted at the back of the sink 3).

The fixture 100 incorporates an elongate, straight spout 1100 which projects level over the basin of the sink 30 from the side. Two air-knife discharge outlets 1700, 1900 are provided on the underside of the spout 1100: one for drying a user's left hand and the other for drying a user's right hand. The outlets 1700, 1900 are spaced apart along the length of the spout 1100. Each outlet 1700, 1900 measures 120 mm across: intended to span the width of a user's hand as it is passed—palm flat—front-to-back underneath the outlets 1700, 1900.

Figure 1:
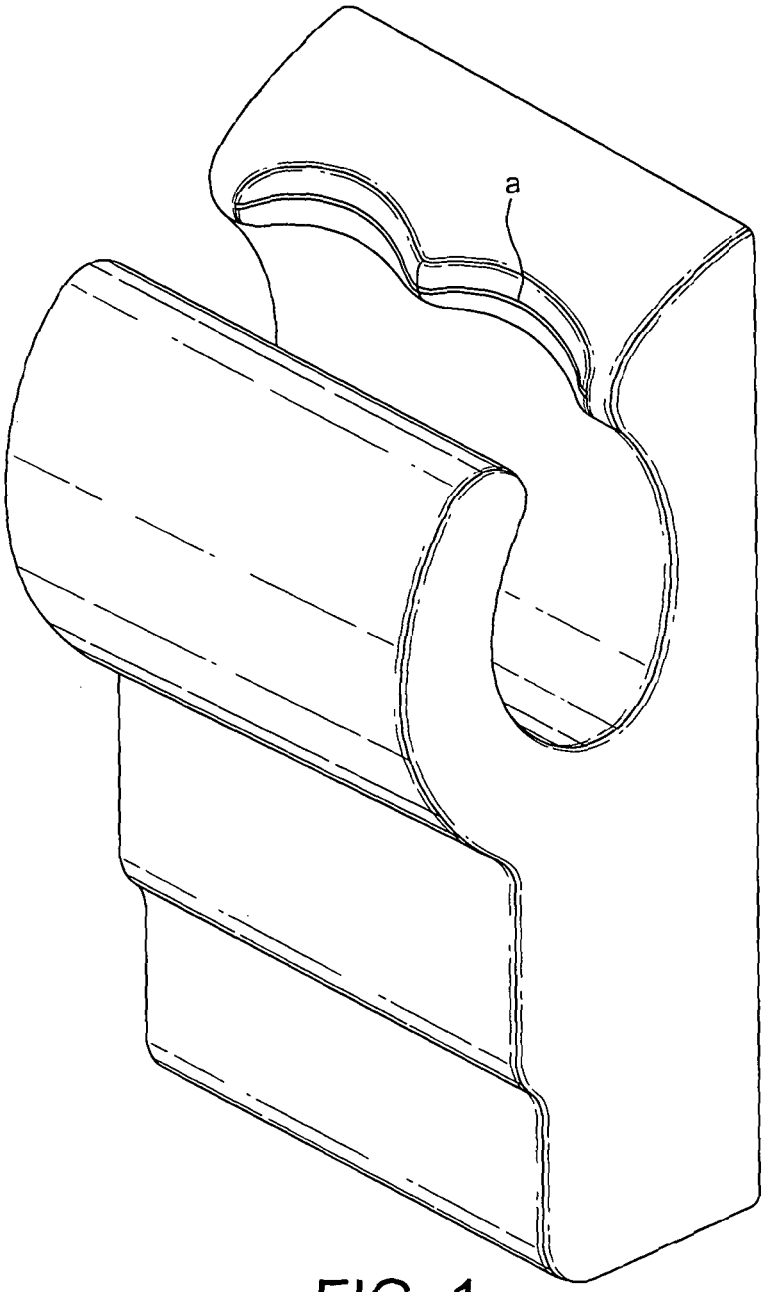
FIG. 1 (PRIOR ART)
FIGS. 1 and 2 are simplified perspective views of conventional air-knife hand dryers.
Figure 2:
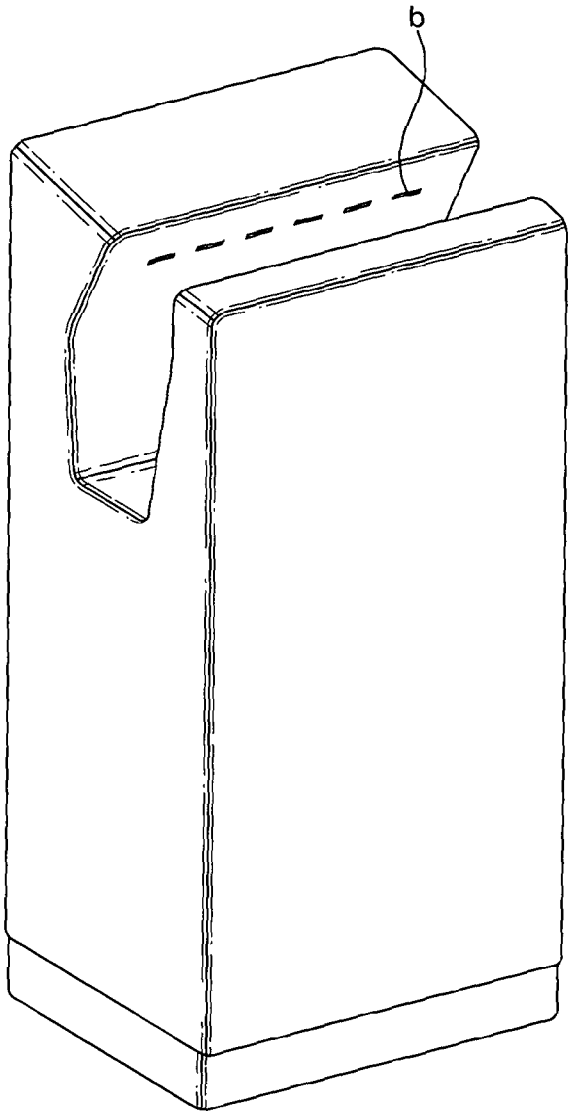
FIG. 2 (PRIOR ART)

The air-knife outlets 1700, 1900 comprise an elongate row of narrow slots (<2 mm wide) analogous to the Mitsubishi arrangement shown in FIG. 2. The spout 1100 itself forms an internal air duct connecting the air-knife outlets 1700, 1900 to an air supply in the form of a motor—driven fan unit (not shown) which locates under the countertop 31.

In use, two respective air-knives are discharged by the outlets 1700, 1900. The air-knife outlets 1700, 1900 are directed down into the basin 30*b* of the sink 30 in accordance with the invention.

A water nozzle 130 is positioned in between the two air-knife outlets 1700, 1900 on the underside of the spout 1100. This water nozzle 130 connects to the mains water supply through the inside of the spout 1100—using a water supply pipe similar to the water supply pipe 15 in FIG. 5.

On demand, water is delivered through the water nozzle 130 via the water supply line and drying air is delivered through the air-knife outlets 1700, 1900 via the spout 1100. The fixture 100 may again be arranged either for manual, semi-automatic or fully automatic (timed) operation.

Figure 10:
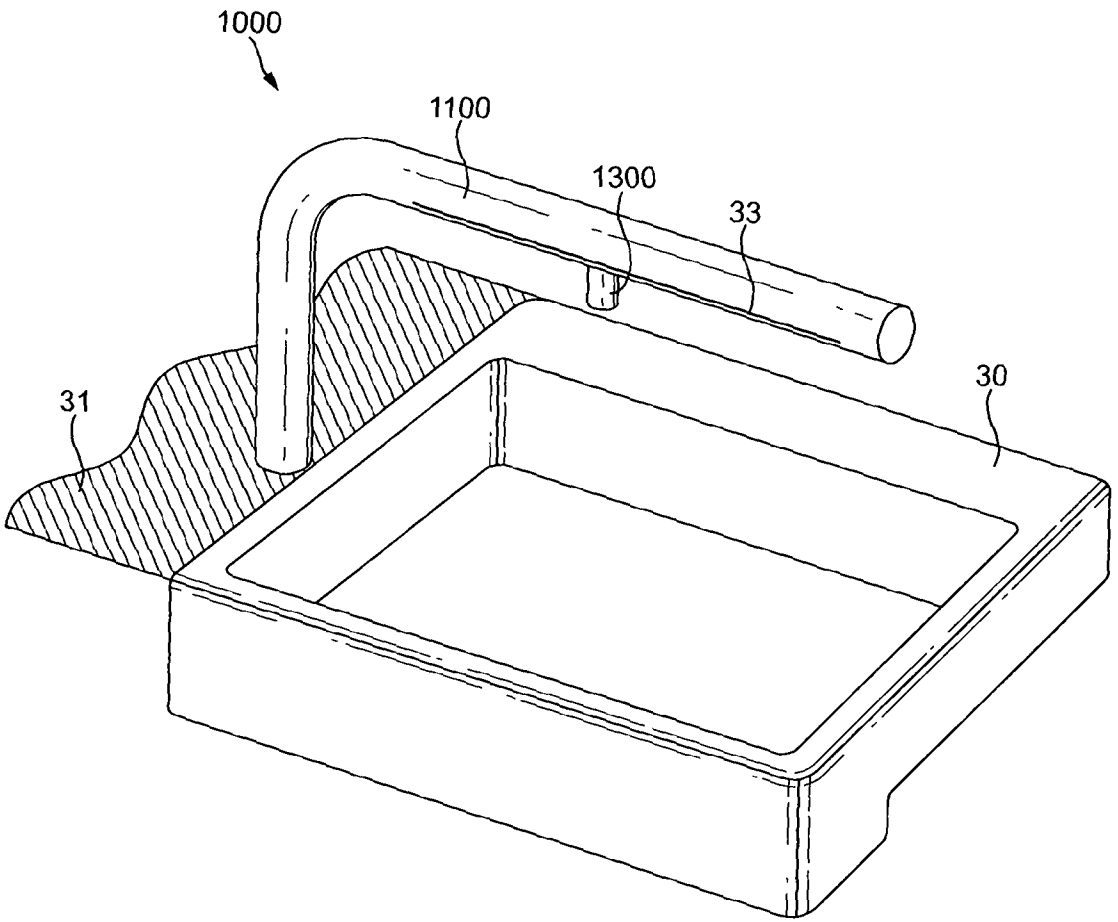
FIG. 10 is a perspective view of an arrangement similar to the on shown in FIG. 9, but comprising a single discharge outlet, rather than two separate discharge outlets.

FIG. 10 shows a similar fixture 1000, but comprising a single "double-span" air-knife discharge outlet 33 intended to span both hands of the user at the same time. Here, the water nozzle 1300 projects downwardly from the underside of the spout 1100, approximately half-way between the ends of the discharge outlet 33.

In each of the described embodiments, the exit airspeed at the outlets should be greater than 80 m/s to provide an effective momentum-drying effect at the surfaces of the hands. Preferably, the exit airspeed is in excess of 150 m/s. An airspeed of around 180 m/s is particularly effective.

In accordance with the invention, the air knife outlet may comprise an elongate line of air holes, rather than slots. The holes may be circular.

The invention claimed is:

1. An arrangement comprising a sink and a sink fixture, the fixture comprising a water spout arranged to project over a basin of the sink, the water spout having a water nozzle arranged for connection through the spout to a water supply, the spout further comprising an elongate air-knife discharge outlet connected to an air supply for discharging an air-knife onto a user's hand, the air-knife discharge outlet being angled downwards at an angle of 25-45 degrees from vertical so that the air-knife is directed down into the basin of the sink.

2. The arrangement of claim 1, wherein the air-knife discharge outlet is provided on an underside of the spout.

3. The arrangement of claim 1, wherein two air-knife discharge outlets are provided on the underside of the water spout, the air-knife discharge outlets being spaced apart along a length of the spout.

4. The arrangement of claim 3, in which the water nozzle is positioned in between the two air-knife discharge outlets.

5. The arrangement of claim 4, wherein each air-knife discharge outlet is provided on a branch duct extending laterally from the water spout, the branch duct connecting to an air supply duct running through the water spout.

6. The arrangement of claim 1, wherein the air supply is arranged to drive airflow through the air-knife discharge outlet at an exit-airspeed of at least 80 m/s.

7. The arrangement of claim 1, wherein the air-knife discharge outlet comprises an elongate discharge aperture or elongate line of discharge apertures.

8. The arrangement of claim 1, wherein the air-knife discharge outlet comprises an elongate air slot or plurality of elongate air slots.

9. The arrangement of claim 8, wherein the width of the slot(s) is less than 2 mm.

10. The arrangement of claim 1, wherein air-knife discharge outlet is at least 80 mm long.

11. The arrangement of claim 1, wherein the air-knife discharge outlet is arranged in fixed position on the spout.

* * * * *